US005213534A

United States Patent [19]

Gardner et al.

[11] Patent Number: 5,213,534

[45] Date of Patent: May 25, 1993

[54] ELECTRICAL CONNECTOR ASSEMBLY FOR FLAT FLEXIBLE CABLE

[75] Inventors: Michael J. Gardner, Pleasanton, Calif.; Bill B. Wilson, Montgomery, Ill.

[73] Assignee: Molex Incorporated, Lisle, Ill.

[21] Appl. No.: 923,074

[22] Filed: Jul. 31, 1992

[51] Int. Cl.[5] ..... H01R 13/00

[52] U.S. Cl. ..... 439/495

[58] Field of Search ..... 439/492–499

[56] References Cited

U.S. PATENT DOCUMENTS

| | | | |
|---|---|---|---|
| 3,149,896 | 9/1964 | Hall | 439/495 |
| 3,696,319 | 10/1972 | Olsson | 339/176 MF |
| 4,890,381 | 1/1990 | Dubois et al. | 439/445 |
| 4,969,840 | 11/1990 | Ii et al. | 439/495 |
| 5,080,595 | 1/1992 | Mouissie | 439/67 |

*Primary Examiner*—Joseph H. McGlynn
*Attorney, Agent, or Firm*—A. A. Tirva

[57] ABSTRACT

An electrical connector assembly is provided for a flat flexible cable having an array of flat conductors arranged thereon at intervals generally parallel to one another and terminating near a distal edge at an end of the cable. A dielectric housing has an elongate recess with a plurality of terminals at intervals along the recess. Each terminal has a contact portion for engaging a respective one of the flat conductors of the flat flexible cable when the cable end is inserted into the recess. An adaptor includes a blade portion insertable into the recess in juxtaposition on one side of the flat flexible cable for biasing the cable conductors into engagement with the contact portions of the terminals on an opposite side of the cable. The adaptor includes at least one wing portion outside of and generally coplanar with the blade portion, with a registration boss projecting from the wing portion. The flat flexible cable includes a registration aperture engageable about the registration boss. Therefore, the adaptor and the properly registered cable can be inserted conjointly into the recess, with the conductors biasingly wiping over the contact portions of the terminals. The flat flexible cable also includes at least one notch in the distal edge thereof, and the adaptor includes a projection adapted to engage in the notch.

17 Claims, 3 Drawing Sheets

ELECTRICAL CONNECTOR ASSEMBLY FOR FLAT FLEXIBLE CABLE

FIELD OF THE INVENTION

This invention generally relates to the art of electrical connectors and, particularly, to an electrical connector assembly for a flat flexible cable.

BACKGROUND OF THE INVENTION

Flat flexible electrical cables have been used for many years, wherein a flat cable includes a flexible substrate having a plurality of flat conductors arranged thereon at intervals parallel to one another. The conductors may be attached to the flexible substrate, inlaid in grooves in the substrate, or the flat flexible cable may be in the form of a flexible printed circuit. A wide variety of electrical connectors have been employed for connecting the respective flat conductors of such cables to respective terminals in the connectors, the terminals having lead wires coupled thereto, or the respective terminals may be coupled to conductors on printed circuit boards.

Generally, prior electrical connectors for flat flexible cable have included dielectric housings having elongate recesses with a plurality of terminals at intervals along the recesses. Each terminal has a contact portion for engaging a respective one of the flat conductors of the flexible cable when an end of the cable is inserted into the recess. Problems always have been encountered in establishing good electrical connections between the flat conductors of the flexible cable and the terminals of the connector, and the problems continue to persist. Consequently, various forms of adapters, connector covers and the like have been employed, removably mounted on the electrical connector, to provide some type of pressure engagement between the flexible cable and the connector terminals.

For instance, in U.S. Pat. No. 4,969,840 to Ii et al, dated Nov. 13, 1990, and assigned to the assignee of the present invention, an electrical connector is disclosed for a flat flexible cable, the connector having a housing with a plurality of terminals arranged at intervals along a recess. A connector cover is removably mounted on the connector housing. The distal end of a flat flexible cable is inserted into the recess, the cable being provided with a lock hole for interengagement with a locking projection in the connector housing. The cover then is inserted into the recess, and the cover has a pressure blade which displaces each terminal and thereby resiliently holds the flat conductors on the flexible cable between a contact portion of each terminal and the pressure blade as well as electrically connecting the flat conductors and the contact portions of the terminal. With such an arrangement, the distal end of the flat flexible cable is inserted into the housing recess in a separate step, before the removable cover and its pressure blade is inserted into the recess. In addition, there is no wiping action of the flat conductors over the contact portions of the terminals, which is desirable in many such electrical connectors.

Another type of flat flexible cable connector is shown in U.S. Pat. No. 3,696,319 to Olsson, dated Oct. 3, 1972. This patent discloses a connector which includes an adaptor in the form of an actuator with a blade portion about which an end of the flexible cable is wrapped such that the cable moves together with the actuator into engagement with the terminal contacts located in the connector housing to provide a wiping action between the cable conductors and the terminal contact portions. However, this patent requires that the substrate at the distal end of the flexible cable be removed to expose the flat conductors which are then located in grooves at the end of the blade portion so that the flat conductors are registered with the connector terminal contact portions. Such an arrangement is unduly tedious and expensive in that it involves stripping the substrate from around the flat conductors and then manipulating the conductors into the grooves of the actuator. Such a system is not very amenable for field termination.

Still another type of electrical connector for flat flexible cable is shown in U.S. Pat. No. 5,080,595 to Mouissie et al, dated Jan. 14, 1992. Like the Olsson patent, an adaptor again includes one or more actuators having blade portions about which the end of a flexible cable is wrapped for insertion into the connector housing. The blade portion has small pins projecting from a nose thereof for insertion into small holes in the flexible cable to maintain registration. Again, such an arrangement requires considerable manipulation of the flexible cable relative to the adaptor and is not very easy to use, particularly for field termination.

This invention is directed to solving the various problems of the prior art, as exemplified above, by providing an extremely simple arrangement of an electrical connector assembly wherein the flat flexible cable can be readily positioned on an adaptor and conjointly inserted into a recess of the connector housing, providing proper registration for the cable as well as a wiping action of the cable conductors over the connector terminals.

SUMMARY OF THE INVENTION

An object, therefore, of the invention is to provide a new and improved, very simple and easily operable electrical connector assembly for a flat flexible cable having a plurality of flat conductors arranged thereon at intervals generally parallel to one another.

In the exemplary embodiment of the invention, the flat conductors of the flexible cable terminate near a distal edge at an end of the cable. The connector assembly includes a dielectric housing having an elongate recess with a plurality of terminals at intervals along the recess. Each terminal has a contact portion for engaging a respective one of the flat conductors of the flexible cable when the cable end is inserted into the recess. An adaptor is provided for operative association with the flat flexible cable and includes a blade portion insertable into the recess of the housing in juxtaposition on one side of the flat flexible cable for biasing the cable conductors into engagement with the contact portions of the terminals on an opposite side of the cable.

The invention contemplates that the adaptor includes at least one wing portion outside of and generally coplanar with the blade portion, with a registration boss projecting from the wing portion. The flat flexible cable includes a registration aperture engageable about the registration boss. Therefore, the adaptor and the cable can be inserted conjointly into the recess, with the flat conductors biased to wipe over the contact portions of the terminals. The cable does not have to be bent or wrapped about any portions of the adaptor, and the manual or other manipulations of the cable relative to the adaptor are extremely simple in nature. The flat flexible cable also includes at least one notch in its distal edge. The adaptor includes a projection adapted to engage in the notch.

Other features of the invention include complementary interengaging latch means between the adaptor and the connector housing. The blade portion of the adaptor has a width complementary to the width of the housing recess so that, when the flexible cable is registered with the adaptor, the adaptor automatically registers the conductors of the cable with the connector terminals. The connector housing, the adaptor and the flexible cable all include mounting openings or holes which are in alignment when the housing, adaptor and cable are fully assembled and through which appropriate fastening means simply can be inserted. The registration boss on the adaptor surrounds one of the mounting holes therein. The registration aperture in the cable comprises the mounting hole therein.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the FIGURES and in which:

DETAILED DESCRIPTION OF THE PREFERRED EMBODIMENT

Figure 1:
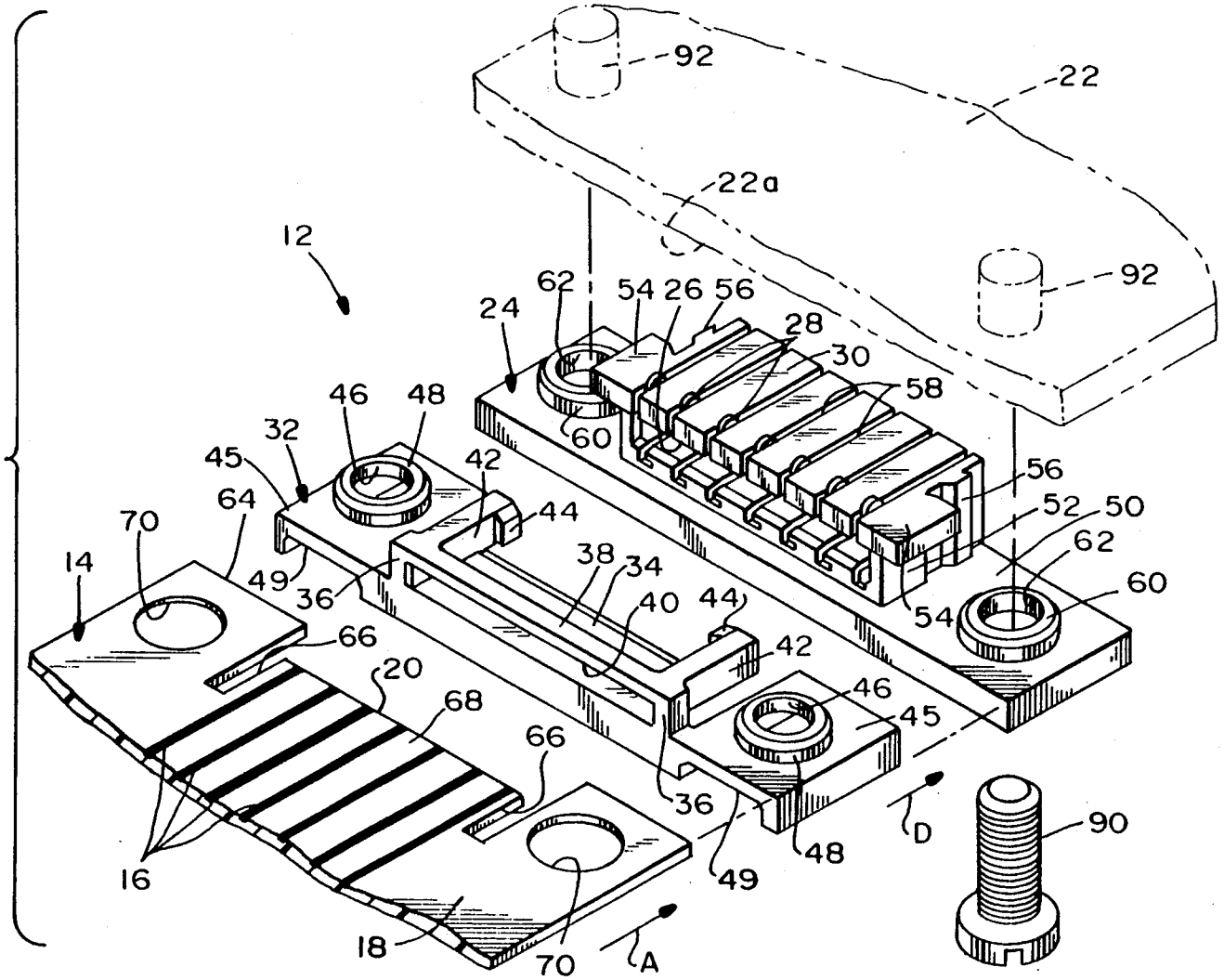
FIG. 1 is an exploded perspective view of an electrical connector assembly embodying the concepts of the invention, in conjunction with a printed circuit board shown in phantom.

Referring to the drawings in greater detail, and first to FIG. 1, the invention is embodied in an electrical connector assembly, generally designated 12, for a flat flexible cable, generally designated 14, having a plurality of flat conductors 16 arranged on a flexible substrate 18 at intervals generally parallel to one another and terminating at a distal edge 20 at an end of the cable. Connector 12 is employed to interconnect conductors 16 to the terminals or conductors of a complementary electrical connector (not shown) or to a printed circuit board, shown in phantom at 22, having circuit traces on an underside **22*a*** of the board.

Electrical connector assembly 12 includes a dielectric housing, generally designated 24, having an elongate recess 26 with a plurality of terminals (described in detail hereinafter) at intervals along the recess. Each terminal includes a terminal portion 28 projecting upwardly from a top surface 30 of the dielectric housing for engaging the circuit traces on underside **22*a* of printed circuit board 22. As will be described in greater detail hereinafter, each terminal also has a contact portion for engaging a respective one of the flat terminals 16 of flexible cable 14 when the cable is inserted into recess 26** of the dielectric housing.

Figure 6:
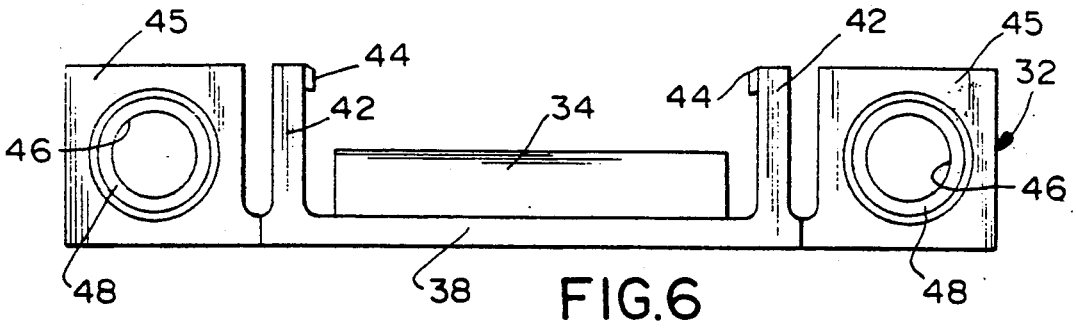
FIG. 6 is a top plan view of the adaptor.
Figure 7:
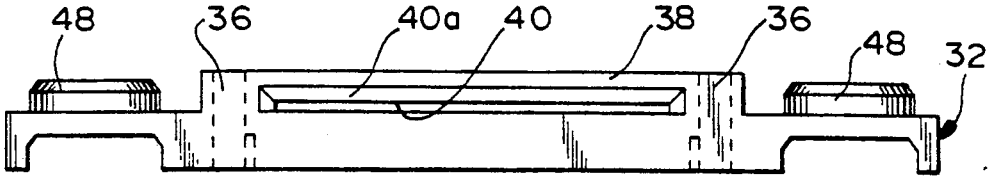
FIG. 7 is a front elevational view of the adaptor.

As seen in FIGS. 6 and 7 in conjunction with FIG. 1, electrical connector assembly 12 also includes an adaptor, generally designated 32, which includes a blade portion 34 insertable into recess 26 of housing 24 in juxtaposition on the underside of flat flexible cable 14 for biasing the cable conductors into engagement with the contact portions of the terminals on the top side of the flexible cable. Adaptor 32 includes a pair of upwardly protruding projections 36 at opposite sides of blade portion 34. The projections are joined at the top thereof by a bridge portion 38 which defines a slot 40 therebeneath. A pair of latch arms 42 protrude rearwardly from projections 36, with latch hooks 44 directed inwardly at the inner distal ends of the latch arms. As best seen in FIG. 7, slot 40 is chamfered, as at **40*a***, to facilitate insertion of the flat flexible cable thereinto, as will be described hereinafter.

Adaptor 32 includes a pair of wing portions 45 outside of and generally coplanar with blade portion 34. A cylindrical registration boss 48 projects upwardly from each wing portion, for purposes described hereinafter. Therefore, a pair of mounting holes 46 are defined by cylindrical registration bosses 48 at each side or end of the adaptor. Lastly, a pair of channels 49 are formed on the underside of each wing portion 45.

Figure 4:
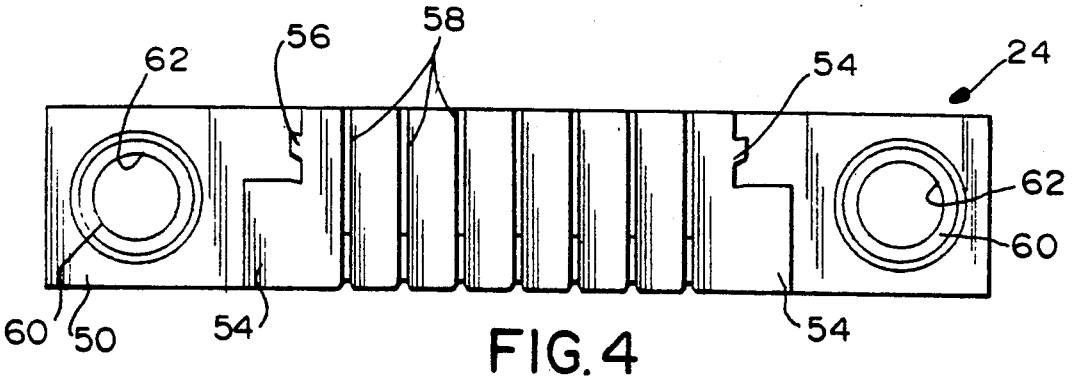
FIG. 4 is a top plan view of the connector housing.
Figure 5:
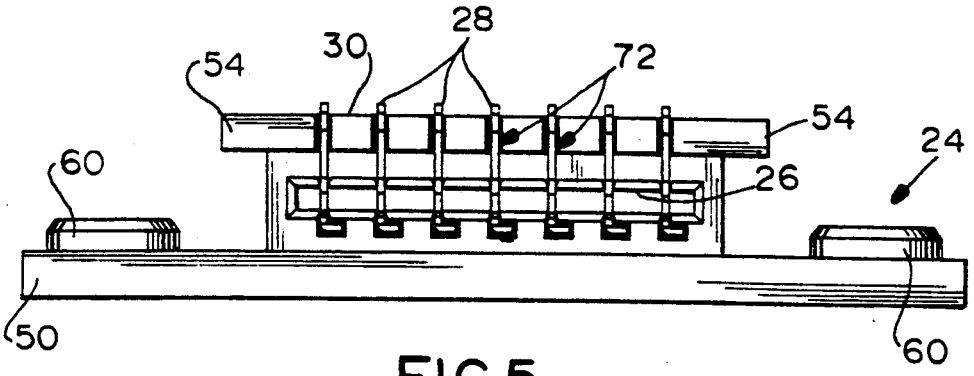
FIG. 5 is a front elevational view of the connector housing assembled with electrical contacts.

Referring to FIGS. 4 and 5 in conjunction with FIG. 1, dielectric housing 24 includes a generally flat base portion 50 and an upstanding housing portion 52. The housing portion defines elongate recess 26 and mounts the terminals therewithin. The housing portion has a pair of outwardly directed flanges 54 beneath which latch arms 42 of adaptor 32 are guided, along with a pair of vertically oriented latch ribs 56 also projecting outwardly therefrom, for locking engagement behind latch hooks 44 of the latch arms. The connector terminals are disposed within vertically oriented cavities 58 in housing portion 52. Lastly, like adaptor 32, housing 24 includes a pair of circular bosses 60 projecting upwardly from base 50 and defining mounting holes 62.

As best seen in FIG. 1, distal edge 20 of flat flexible cable 14 is recessed inwardly of an end 64 of the cable. A pair of notches 66 are formed in the cable outside the array of parallel flat conductors 16. Therefore, recessed distal edge 20 and notches 66 define a tongue 68 which is insertable into slot 40 of adaptor 32. When so inserted, projections 36 of the adaptor engage within notches 66, with tongue 68 of the cable overlying blade portion 34 of the adaptor. Flat flexible cable 14 has a pair of side registration apertures or holes 70. These holes perform dual functions. First, they are located for engagement about cylindrical registration bosses 48 which project upwardly from wing portions 45 of adaptor 32. Therefore, the flat flexible cable is completely registered transversely of the adaptor when the cable is assembled to the adaptor in the direction of arrow "A" (FIG. 1), with tongue 68 inserted into slot 40 of the adaptor. Second, holes 70 provide mounting holes for appropriate fasteners, as described hereinafter.

Figure 8:
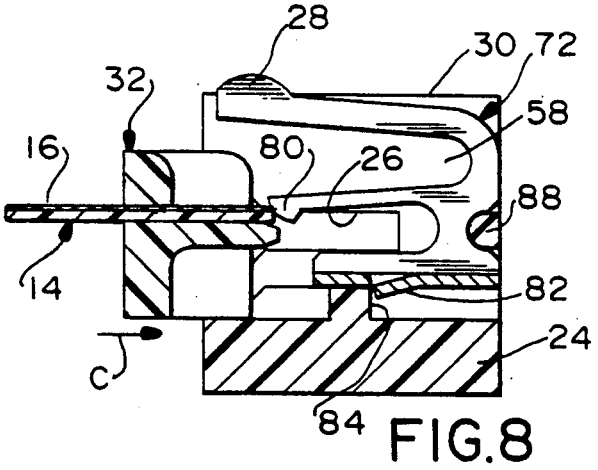
FIG. 8 is a vertical section taken generally along line 8—8 of FIG. 2.
Figure 11:
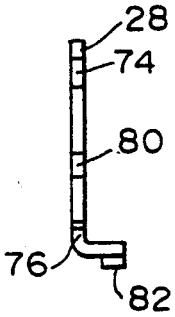

Referring to FIGS. 8–11, as stated above, a plurality of terminals, generally designated 72, are mounted in housing portion 52 (FIG. 1) of dielectric housing 24 at intervals along recess 26, i.e. transversely of the connector housing. Each terminal has a generally trifurcated configuration defined by an upper leg 74, a lower leg 76 and a middle leg 78. Each terminal is stamped and formed from sheet metal material. The upper legs of the terminals have distal ends which define terminal portions 28, defined above, projecting above upper surface 30 of the housing for engaging circuit traces on the underside 22*a* of printed circuit board 20. Middle leg 78 of each terminal has a contact portion 80 projecting downwardly into recess 26, as best seen in FIG. 8, for engaging a respective one of the flat conductors 16 on flexible cable 14. Lower leg 76 of each terminal has a locking tongue 82 bent downwardly therefrom for snapping engagement behind a locking surface 84 of housing 24, at the bottom of each cavity 58 in the housing. Lastly, the rear of each terminal 72 has a locating notch 86 for embracing a locating rib 88 formed integrally with the housing and spanning each cavity 58.

Figure 10:
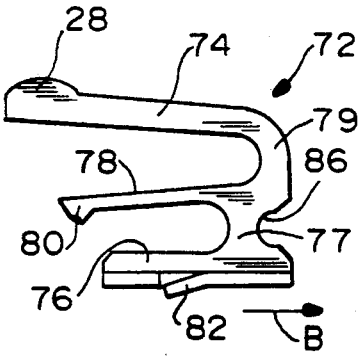
FIG. 10 is a side elevational view of one of the terminals of the connector assembly; and FIGURE is a front elevational view of the terminal shown in FIG. 10.

Terminals 72 are assembled into housing 24 in the direction of arrow "B" (FIG. 10). Upon complete insertion, locating notch 86 embraces locating rib 88 and locking tongue 82 snaps behind locking surface 84 to retain the terminal within its respective cavity 58. Each cavity is slightly wider than the thickness of the terminal whereby the terminal legs 74 and 78 can flex vertically as viewed in the drawings. When fully assembled, terminal portion 28 of each terminal projects upwardly above surface 38 of the housing, and contact portion 80 of each terminal projects into recess 26.

Figure 2:
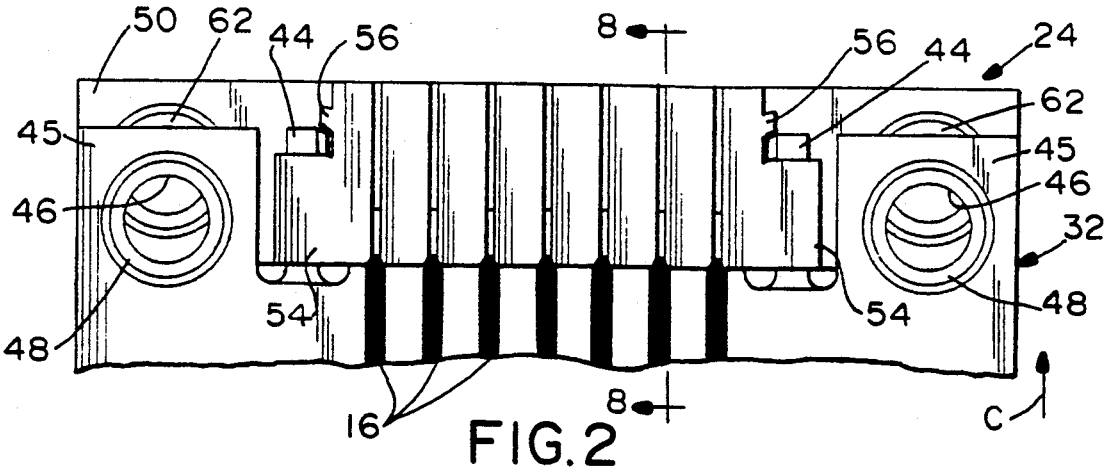
FIG. 2 is a fragmented top plan view of the adaptor and flat flexible cable being inserted into the connector housing.
Figure 3:
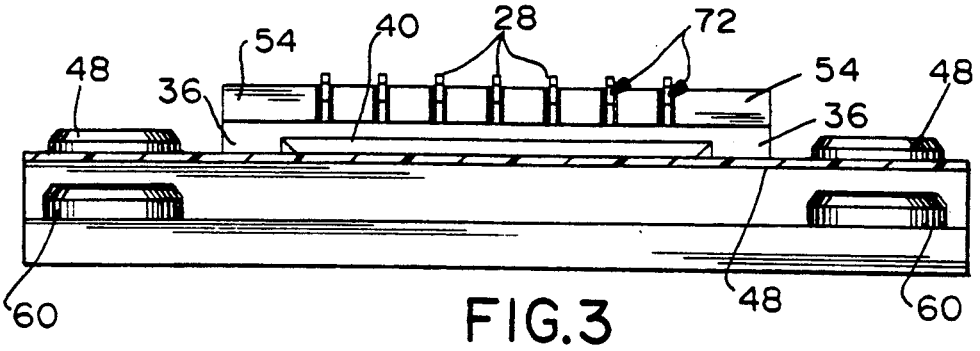
FIG. 3 is an elevational view looking toward the front of FIG. 2.

The assembly of flat flexible cable 14 and connector assembly 12 is extremely simple. The cable is assembled to adaptor 32 as described above in relation to FIG. 1, in the direction of arrow "A", with tongue 68 of the cable being inserted into slot 40 of the adaptor, and with registration apertures 70 of the cable embracing registration bosses 48 of the adaptor. When so assembled, projections 36 of the adaptor enter notches 66 of the cable. When so assembled, mounting holes 46 in the adaptor are aligned with apertures 70 in the cable. This subassembly then is assembled to connector housing 24, and FIGS. 2, 3 and 8 show the subassembly being partially inserted into the housing in the direction of arrow "C". Channels 49 on the underside of wing portions 45 of the adaptor accommodate circular bosses 60 of housing 24. It can be seen in FIG. 2 that the mounting holes 46 of adaptor 32 are not quite aligned with mounting holes 62 of the connector housing, and that latch hooks 44 of the adaptor have not as yet engaged behind latch ribs 56 of the housing. It also can be seen in FIG. 2 that the opposing surfaces of the latch hooks and latch ribs are angled or chamfered so that, upon further insertion movement in the direction of arrow "C", the latch hooks will ride over the latch ribs.

Figure 9:
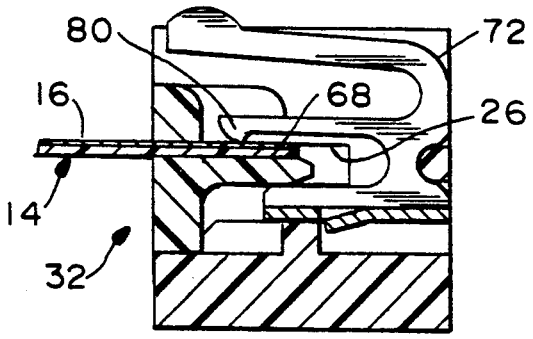
FIG. 9 is a vertical section similar to that of FIG. 8, with the adaptor and flat flexible cable fully inserted into the connector housing.

Now, referring to FIG. 9, it can be seen that adaptor 32 and its assembled flat flexible cable 14 have been fully assembled to connector housing 24. In other words, blade portion 34 of the adaptor and tongue 68 of the cable have been inserted into recess 26 of the housing. With the flexible cable resting on or juxtaposed on top of blade portion 34, flat conductors 16 are moved in a biasing wiping action over contact portions 80 of terminals 72, the adaptor having properly registered the flat flexible cable, as described above.

As can be seen in FIG. 9, insertion of the blade portion 34 with the flat flexible cable 14 into connector housing 12 moves middle leg 78 of each terminal 72 connected by a section 77 to lower leg 76 away from leg 76. When the connector assembly 12 is mated with a printed circuit board this upper leg 74 of each terminal 74 connected by a section 77 to middle leg portion 78 is moved towards the middle leg portion 78. Sections 77 and 79 have predetermined cross-sectional areas, which may be determined experimentally, such that forces developed by movement of leg portions 74 and 78 are taken up completely by material in Sections 79 and 77, respectively, such that movement of one of the legs does not affect the other and thus electrical integrity between terminals 72 and conductors 16 of the flat flexible cable and conductive traces 22*a* of printed circuit board 22 are maintained at all times.

From the above description of the assembly of flat flexible cable 14, adaptor 32 and connector housing 24, it can be seen that the assembly procedure or manipulations are extremely simple. The flexible cable is assembled to the adaptor in the direction of arrow "A", as described above, and this subassembly then is assembled to housing 24 in the same direction, as indicated by arrow "D". When so assembled, appropriate fasteners 90 can be inserted through apertures 70 in the flat flexible cable, mounting holes 46 in the adaptor and mounting holes 62 in the connector housing to hold all the components in fully assembled condition, and the fasteners can be used to secure the assembly to an appropriate mating connector or to printed circuit board 22, as by threading the fasteners into threaded receptacle means 92.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector assembly for a flat flexible cable having an array of flat conductors arranged thereon at intervals generally parallel to one another and terminating near a distal edge at an end of the cable, a dielectric housing having an elongate recess with a plurality of terminals at intervals along the recess, each terminal having a first contact portion for engaging a respective one of the flat conductors of the flat flexible cable when the cable end is inserted into the recess, and an adaptor including a planar blade portion insertable into the recess in juxtaposition on one side of the flat flexible cable at said end thereof for biasing the cable conductors into engagement with the contact portions of the terminals on an opposite side of the cable, wherein the improvement comprises said adaptor including a wing portion outside of and generally coplanar with the blade portion, the wing portion including a registration boss projecting therefrom, and said flat flexible cable including a registration aperture engageable about the registration boss, whereby the adaptor and the cable can be inserted conjointly into the recess with the conductors biasingly wiping over the contact portions of the terminals.

2. In an electrical connector assembly as set forth in claim 1, wherein said registration boss surrounds a mounting hole in the wing portion.

3. In an electrical connector assembly as set forth in claim 2, wherein said registration box is generally cylindrical and said registration aperture is generally circular and of a size to fit over the cylindrical boss.

4. In an electrical connector assembly as set forth in claim 1, including a pair of said wing portions respectively located outside opposite sides of the blade portion and each wing portion including one of said registration bosses, and said flat flexible cable includes a pair of said registration apertures engageable about the pair of registration bosses.

5. In an electrical connector assembly as set forth in claim 4, wherein said registration bosses surround a pair of mounting holes in the wing portions.

6. In an electrical connector assembly as set forth in claim 4, wherein the flat flexible cable includes a pair of notches in said distal edge thereof and located inside of and spaced from the registration apertures to define a tongue portion of the cable between the notches, and the adaptor includes an elongate slot through which the tongue portion is inserted into juxtaposition with the blade portion of the adaptor.

7. In an electrical connector assembly as set forth in claim 6, wherein the adaptor includes a pair of projections adapted to engage in said notches.

8. In an electrical connector assembly as set forth in claim 1, wherein each terminal has a second contact portion extending from the housing for engaging a respective conductive area of a printed circuit board or the like.

9. In an electrical connector assembly as set forth in claim 8, wherein said first and second contact portions of each terminal are joined by a section of a predetermined cross-sectional area such that forces generated by engagement of flat conductors and conductive areas by first and second contact portions respectively, are not transmitted from one contact portion to the other whereby electrical integrity is maintained at all times.

10. In an electrical connector assembly for a flat flexible cable having an array of flat conductors arranged thereon at intervals generally parallel to one another and terminating near a distal edge at an end of the cable, a dielectric housing having an elongate recess with a plurality of terminals at intervals along the recess, each terminal having a contact portion for engaging a respective one of the flat conductors of the flat flexible cable when the cable end is inserted into the recess, and an adaptor including a blade portion insertable into the recess in juxtaposition on one side of the flat flexible cable at said end thereof for biasing the cable conductors into engagement with the contact portions of the terminals on an opposite side of the cable, wherein the improvement comprises said flat flexible cable including at least one notch in said distal edge thereof, and said adaptor including a projection adapted to engage in the notch.

11. In an electrical connector assembly as set forth in claim 10, wherein said blade portion has a transverse width slightly smaller than the elongate dimension of the recess in the housing.

12. In an electrical connector assembly as set forth in claim 10, wherein the flat flexible cable, the dielectric housing and the adaptor all have mounting holes which are in alignment when the adaptor and the cable are inserted into the recess into the housing.

13. In an electrical connector assembly as set forth in claim 10, wherein said flat flexible cable has a pair of said notches spaced outside of said array of flat conductors, and the adaptor includes a pair of said projections adapted to engage in the pair of notches.

14. In an electrical connector assembly as set forth in claim 13, wherein the pair of notches in the flat flexible cable define a tongue portion of the cable therebetween, and the adaptor includes an elongate slot through which the tongue portion is inserted into juxtaposition with the blade portion of the adaptor.

15. In an electrical connector assembly as set forth in claim 14, wherein said blade portion extends from the elongate slot in an insertion direction of the flat flexible cable.

16. In an electrical connector assembly as set forth in claim 14, including a pair of latch arms projecting rearwardly of said projections, and said housing includes a pair of complementarily interengaging latches.

17. In an electrical connector assembly as set forth in claim 14, wherein an end of said tongue portion defines said distal edge of the flat flexible cable, the distal edge being recessed inwardly of the end of the cable.

* * * * *